US006712409B2

(12) United States Patent
Mönig

(10) Patent No.: US 6,712,409 B2
(45) Date of Patent: Mar. 30, 2004

(54) EXTERNAL DOOR HANDLE FOR VEHICLES

(75) Inventor: Stefan Mönig, Schwelm (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/105,095

(22) Filed: Mar. 23, 2002

(65) Prior Publication Data

US 2002/0148075 A1 Oct. 17, 2002

(30) Foreign Application Priority Data

Mar. 24, 2001 (DE) ..... 101 14 583

(51) Int. Cl.[7] ..... E05B 3/00

(52) U.S. Cl. ..... 292/336.3; 292/DIG. 65; 292/DIG. 23

(58) Field of Search ..... 292/DIG. 65, DIG. 22, 292/DIG. 23, 336.3, 92, 93; 188/267.1, 266.1, 266.2

(56) References Cited

U.S. PATENT DOCUMENTS 2,417,850 A * 3/1947 Winslow ..... 361/207
5,076,403 A * 12/1991 Mitsui ..... 188/267.1
5,468,042 A * 11/1995 Heinrichs et al. ..... 296/146.4
5,497,861 A * 3/1996 Brotz ..... 188/267.1
5,582,385 A * 12/1996 Boyle et al. ..... 248/550
5,984,385 A * 11/1999 Shtarkman et al. ..... 292/251.5
6,047,797 A * 4/2000 Popjoy ..... 188/269
6,138,998 A * 10/2000 Parker et al. ..... 267/140.15
6,145,638 A * 11/2000 Popjoy ..... 188/322.13
6,206,153 B1 * 3/2001 Popjoy ..... 188/300
6,241,294 B1 * 6/2001 Young et al. ..... 292/336.3
6,318,521 B1 * 11/2001 Niaura et al. ..... 188/267.1

FOREIGN PATENT DOCUMENTS

| | | |
|---|---|---|
| DE | 2023859 | 11/1971 |
| DE | 197 54 167 A1 | 6/1999 |
| DE | 199 10 328 A1 | 9/2000 |
| DE | 199 24 685 A1 | 11/2000 |
| DE | 199 63 580 A1 | 8/2001 |

* cited by examiner

*Primary Examiner*—Robert J. Sandy
*Assistant Examiner*—Thomas Ho
(74) *Attorney, Agent, or Firm*—Friedrich Kueffner

(57) ABSTRACT

A door handle for vehicles includes a connecting member adapted to act on a lock when the handle is actuated, and a normally inactive crash locking unit for the connecting member. A crash sensor is connected to the crash locking unit so as to activate the crash locking unit in the event of a crash, so that the crash locking unit blocks the connecting member and the inertia forces which act to actuate the handle are not transmitted to the lock. The connecting member includes a drive member movable together with the connecting member, and the drive member is mounted in a liquid medium so as to be moved in this medium when the connecting member is moved. The viscosity of the medium changes in dependence on an electrical field acting in the medium. The crash sensor controls the electrical field prevailing in the medium.

3 Claims, 2 Drawing Sheets

EXTERNAL DOOR HANDLE FOR VEHICLES

BACKGROUND OF THE INVENTION

1. Field of the Invention

The present invention relates to an external door handle, particularly for vehicles which when actuated acts through a connecting member on a lock. The handle includes a crash locking means for the connecting member, wherein the crash locking means is normally inactive. A crash sensor reacting to inertia forces renders the crash locking means active when a crash occurs. As a result, the crash locking means blocks the connecting means and an inertia force which acts on the handle as a result of the crash to actuate the handle is not transmitted to the lock.

2. Description of the Related Art

When the handle of a vehicle is actuated, a connecting member acts on a lock. In the event of a crash, inertia forces act on the handle and the members connected to the handle. These inertia forces may have the result that the handle carries out an undesirable actuating movement and opens the lock as a result. This causes the door to open and the passengers sitting in the vehicle could be ejected from the vehicle. Crash locking means are used to prevent this.

Such crash locking means act on the connecting member, but they are normally inactive. However, a crash sensor exists which reacts to inertia forces and makes the crash locking means active in the case of a crash. In that case, the connecting member is blocked and an actuation of the handle remains inactive.

It is known from DE 199 10 328 A1 to use a cylinder/piston unit between an external door handle and a connecting member which acts on a lock. A liquid is arranged in the cylinder and the piston has through openings which normally are held open by a blocking member, such as a sealing disk. When the door handle or the connecting member is initially quickly adjusted as the result of an accident, the piston is slightly moved in the liquid. The resulting flow of the liquid between the two chambers in the cylinder separated by the piston causes an at least slight pressure increase in one of the chambers, so that the blocking element closes the through opening. Any further movement of the piston in the cylinder is now no longer supposed to be possible. This known crash locking means is not operationally safe. The adjustment of the sensor in the interior of the cylinder to the correct reaction value is difficult.

Such crash locking means are usually constructed as a so-called "mass locking means". For example, in an external door handle constructed as a pull handle and known from DE 20 23 859 B2, an additional mass acts on the shaft of the handle which serves as a connecting member. The additional mass is mounted on one arm of a two-arm lever and is biased by a tension spring which ensures that the arm of the lever normally engages behind a projection of the shaft. In the case of a normal actuation of the handle, this spring load is usually overcome, so that the lever releases the projection at the handle shaft. However, in the case of a crash, such a high inertia force acts on the additional mass that the other lever arm holds the projection and, thus, prevents an actuation of the handle resulting from an inertia force. Also, mass locking means interfere with the normal operation of the door handle.

It is also known in the art from DE 199 24 685 A1 to use between a latch and an actuating lever a switchable coupling which operates with an electrorheological liquid. The axis of the actuating lever is fixedly connected to a rotary cylinder which is located in a hollow cylinder. The hollow cylinder, in turn, is fixedly connected to the latch. The electrorheological liquid is located in the free space between the rotary cylinder and the hollow cylinder, where the electrodes for producing an electrical field are also located. In dependence on the electrical field, the liquid changes from a low viscous state through the plastic state to a solid state. When the liquid solidifies, the coupling is active and when the actuating lever is turned, the latch is also moved. The use of a crash sensor for controlling the state of aggregation of the liquid is not provided.

Finally, it is also known in the art from DE 197 54 167 A1 to use an electrorheological liquid for blocking a component which can be pivoted about an axis, for example, a door which is to be opened by a certain angle and then locked. A position sensor determines the respective angle position of the door and the position is made available to an electronic evaluation unit. The electronic evaluation unit compares the actual position of the door with the intended position and acts on an electronic control unit which controls the state of aggregation of the liquid through electrodes which are arranged on a rotary piston, on the one hand, and on a fixed cylinder, on the other hand. The rotary piston is fixedly connected to the door. Once the desired pivoting position of the door has been reached, the electrorheological liquid changes into its solid state which leads to locking of the door in the angle position. The use in connection with crash locking means is not provided.

SUMMARY OF THE INVENTION

Therefore, it is the primary object of the present invention to develop an external door handle of the type described above which avoids the disadvantages of the known crash locking means.

In accordance with the present invention, the connecting member of the door handle has a drive member which is movable with the connecting member. The drive member is arranged in a liquid medium and moves in this medium when the connecting member is actuated. The viscosity of the medium is changeable in dependence on an electrical field acting on the medium. The crash sensor controls the electrical field prevailing in the medium.

The crash locking means according to the invention operates in accordance with a principle which is completely different and novel as compared to the known crash locking means. In the event of a crash, the invention only changes the viscosity of the liquid medium. Such media are called "SKS-intelligent materials". This medium changes its viscosity in dependence on an electrical voltage, i.e., in dependence on an electrical field prevailing in the medium. The medium is normally highly liquid and permits an easy movement of the drive member in the medium when the handle is actuated. The remaining flow resistance of the medium can even be usefully utilized for damping the actuation of the handle. This is of interest in case of door handles which are subject to a restoring force and which are supposed to move back into their initial positions as noiselessly as possible. In this connection, a principle can be utilized which is known from the very different field of "door closers", in which the actuation of the handle is to be easy and smooth, but its return movement is to be dampened by suitable valves or labyrinths.

However, the gist of the invention resides in applying in the event of a crash an electrical field to the medium which is so high that a movement of the drive member in the medium is essentially blocked. It is sufficient for this purpose to provide a sensor which responds to inertia forces and actuates an electrical switch for an electrical field to be produced in the medium. The drive member and the medium can be located at any selected location in the chain of elements between the handle and the lock. Moreover, the crash sensor can also assume other functions, for example, transmitting an alarm of the accident through radio or the like to monitoring stations located outside of the vehicle.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
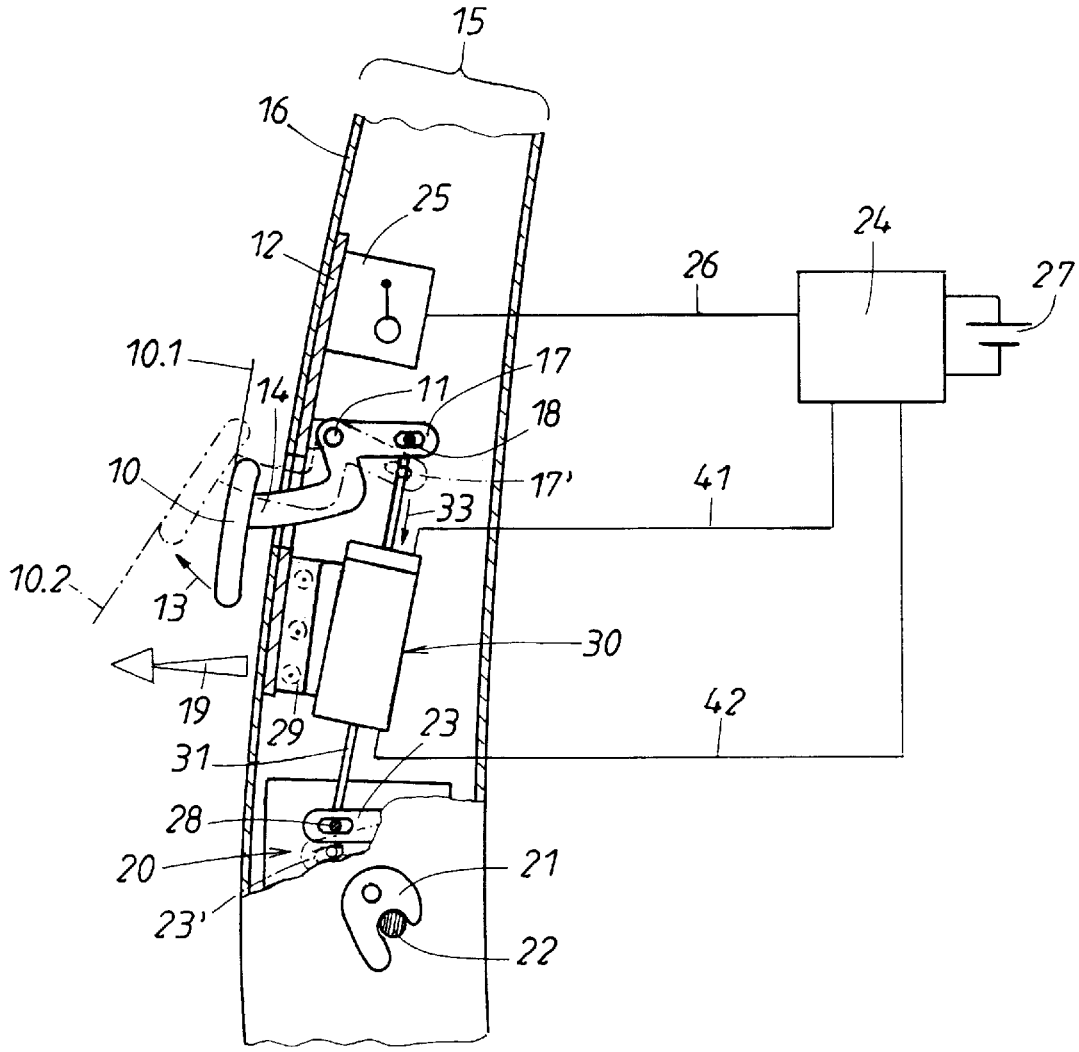
FIG. 1 is a schematic top view, partially in section, of the rabbet of a door, shown in cross section.

An external door handle 10 serves for actuating a lock 20 which, in the illustrated case, has a rotary catch 21 as the closing means. As illustrated in FIG. 1, the rotary catch 21 is normally supposed to hold a door 15 in the closed position. In this position, the handle 10 is in a position of rest indicated by an auxiliary line 10.1 and the rotary catch 21 is in engagement with a locking bolt 22 which is mounted stationarily on the vehicle body.

The handle 10 can be actuated through an axis 11 mounted on a support member 12 in the direction of arrow 13. The support member 12 is mounted on the inner side of an outer door lining 16 and an arm 14 acting on the handle 10 extends from the axis 11 through cutouts in the support member and the outer lining 16. Restoring forces which are not identified in the drawing hold the grip 10 in the above-mentioned position of rest 10.1. The movement 13 of the handle 10 is transmitted to a work arm 17 which is mechanically connected to the lock 20 through a special connection 30. The connection includes a connecting member which in the illustrated embodiment is constructed as a longitudinally movable rod 31, wherein one end of the rod 31 is connected to the work arm 17 of the handle 10 through a combined joint and push connection 18. The other end of the rod is analogously coupled to an input member 23 of the lock 20 through a joint and push connection 28 provided at this location.

For opening the door 15, the handle 10 is grasped and moved into the actuated position 10.2 shown in dash-dot lines in FIG. 1. This movement 13 is transmitted to the work arm on the side of the handle, wherein the work arm then reaches the actuated position 17' also shown in dash-dot lines in FIG. 1. This results in a longitudinal movement 33 of the rod 31 indicated by an arrow in FIG. 1. In this manner, the handle movement 13 is transmitted through the rod 31 to the input member of the lock which reaches the actuated position which is also shown in dash-dot lines. The rotary catch 21 is unlocked through the lock members following the input member 23' and the locking bolt 22 is released. The door 15 can now be opened.

Figure 2:
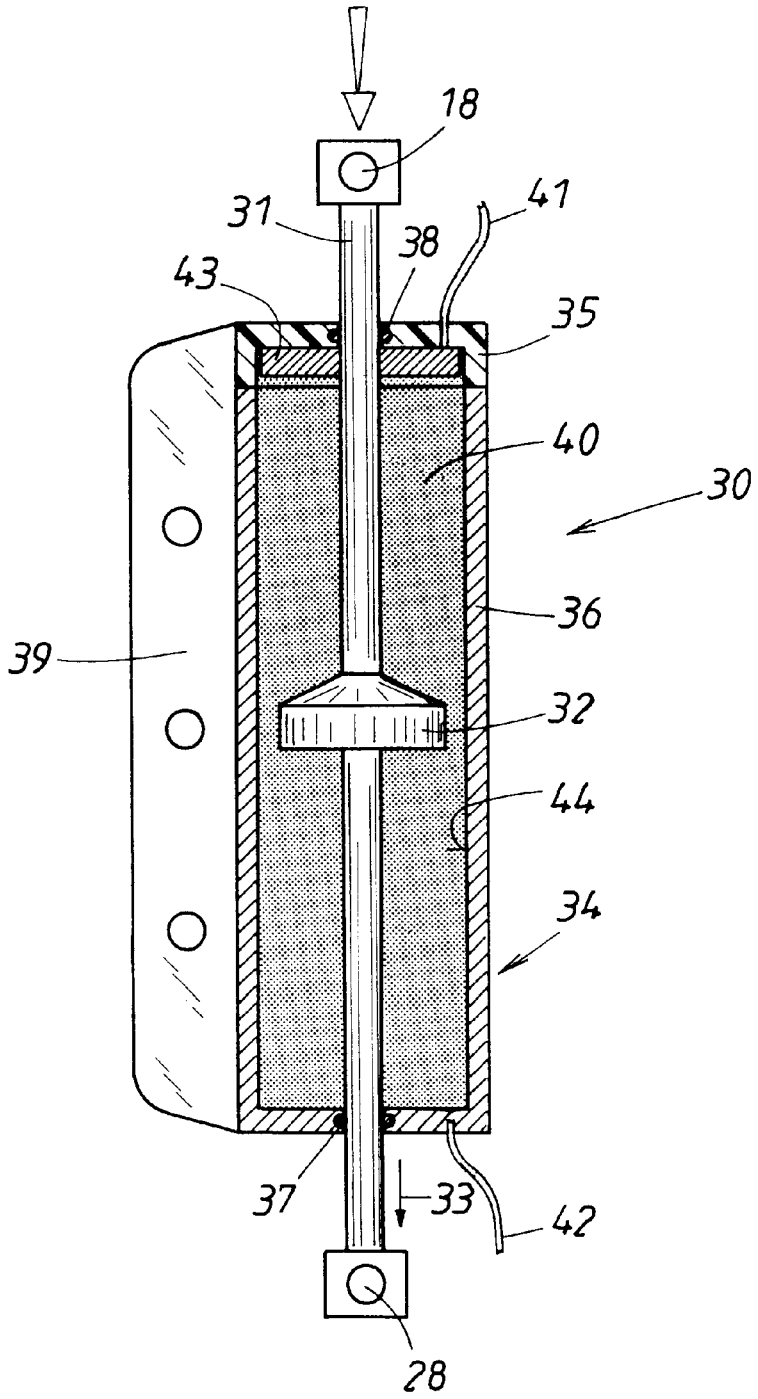
FIG. 2 is an axial sectional view, on a larger scale, showing a component of the device of FIG. 1.

In the event of a crash, inertia forces act on the handle and the elements following the handle in the chain of elements up to the lock 20. Consequently, in the case of an accident, the inertia force indicated in FIG. 1 by arrow 19 can act on the door 15, wherein a component of the force is produced for carrying out a handle actuation 13. Accordingly, in the case of an accident, there is the danger that the handle 10 is moved in an undesired manner into its actuated position 10.2 by the inertia forces acting directly or indirectly on the handle. If no other special precautions are taken, this leads to a movement 33 of the connecting member 31 and, thus, to an open position of the lock 20. The door 15 opens and the passengers in the vehicle can be ejected and seriously insured as a result. This is prevented by a crash locking means which acts on the connecting member 31, wherein the crash locking means according to the present invention is constructed in the manner illustrated in FIG. 2.

Mounted on a rod 31 which acts as the connecting member is a drive member 32 which is movable with the rod 31; the drive member 32 is constructed as an axially fixed piston mounted on the rod 31. The rod 31 extends through a cylinder 34 which serves as a container for a special medium 40. The cylinder 34 is fixedly mounted in the door 15 at 29, wherein, for this purpose, a suitable assembly strip 39 may be provided. For reasons of assembly, the cylinder 34 is composed of two axial portions 35, 36, wherein the rod 31 extends through the two end faces of the cylinder, and wherein rod sealing means 37, 38 are provided at the end faces.

In the normal situation, the medium 40 in the interior of the cylinder is highly liquid. During a rod movement 33, the piston 32 can be moved almost without any resistance within the cylinder interior. The remaining liquid flow of the medium 40 can advantageously be utilized for damping a return movement of the handle due to restoring springs from its actuated position 10.2 into its position of rest 10.1. For this purpose, labyrinths and/or valves can be provided in the area of the piston 32 or the cylinder 34.

However, in the case of an accident, the properties of the medium 40 are radically changed; the medium becomes extremely viscous. In this connection, a special property of the medium 40 is utilized which is the fact that the viscosity of the medium changes in dependence on an electrical field applied to the medium. By applying a sufficiently high electrical field, the medium 40 becomes so viscous that the piston 32 is stationary in the cylinder 34. Thus, a movement 33 of the rod 31 is blocked. Consequently, the door handle 10 remains in its position of rest 10.2 even if high inertia forces 19 act on the handle during an accident.

FIG. 1 also shows schematically those electrical or electronic components which serve to produce the above-mentioned electrical field in the interior of the medium 40. For this purpose, a crash sensor 25 is provided in the vehicle, wherein the crash sensor 25 responds when the inertia forces produced in the vehicle exceed a predetermined value. In that case, a signal is supplied through a line 26 to a control unit 24 which is in connection with a voltage source 27. The voltage source 27 may be a vehicle battery. In the event of a crash, the control device 24 switches a switch which through electrical lines 41, 24 applies an electrical voltage to electrodes 43, 44 in the interior of the cylinder 34. In accordance with the invention, the upper cylinder portion 35 is of a material which is capable of being insulated; for this reason, an electrically conductive material is located in the cylinder interior which serves as electrode 43 for connecting one line 41. The lower cylinder portion 36 is already of an electrically conductive material so that its inner surface 44 may act as an electrode. Accordingly, the corresponding second electrical line 42 is connected to the container wall of this lower cylinder portion 36.

The invention is not limited by the embodiments described above which are presented as examples only but can be modified in various ways within the scope of protection defined by the appended patent claims.

I claim:

1. A door handle for vehicles comprising a longitudinally movable connecting rod for coupling the handle to a lock, a crash locking means for the connecting rod, wherein the crash locking means is normally inactive, and a crash sensor configured to react to inertia forces, wherein the crash sensor is connected to the crash locking means so as to activate the crash locking means in the event of a crash, whereby the crash locking means blocks the connecting rod in the event of a crash and the inertia forces which act to actuate the handle are not transmitted to the lock, wherein the connecting rod comprises a piston movable together with the connecting rod, wherein the piston is arranged in a stationary container and the connecting rod extends through the container, wherein the container contains a liquid medium so that the piston is moved in this medium when the connecting rod is moved, wherein the viscosity of the medium changes in dependence on an electrical field acting in the medium, further comprising a switch which normally is in a switched-off position and keeps the medium free of electrical voltages and highly liquid, so that an essentially free movement of the piston in the medium is possible, wherein the crash sensor is connected to the switch such that in the event of a crash the crash sensor switches on the switch and an electrical field is generated in the medium, so that the medium becomes viscous and a movement of the piston in the medium is essentially blocked.

2. The door handle according to claim 1, wherein wall portions of the container support electrodes to which the electrical voltage can be applied.

3. The door handle according to claim 1, wherein wall portions of the container are electrodes to which the electrical voltage can be applied.

* * * * *